US011504587B2

(12) United States Patent
Tsunashima et al.

(10) Patent No.: US 11,504,587 B2
(45) Date of Patent: Nov. 22, 2022

(54) GOLF CLUB HEAD

(71) Applicant: Sumitomo Rubber Industries, Ltd., Hyogo (JP)

(72) Inventors: Hiromasa Tsunashima, Kobe (JP); Masahide Onuki, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/102,578

(22) Filed: Nov. 24, 2020

(65) Prior Publication Data

US 2021/0154537 A1 May 27, 2021

(30) Foreign Application Priority Data

Nov. 26, 2019 (JP) ..... JP2019-213471

(51) Int. Cl.
*A63B 53/04* (2015.01)
*A63B 102/32* (2015.01)

(52) U.S. Cl.
CPC ..... *A63B 53/0466* (2013.01); *A63B 53/0408* (2020.08); *A63B 53/0412* (2020.08); *A63B 2102/32* (2015.10)

(58) Field of Classification Search
CPC ..... A63B 53/0416; A63B 53/0425; A63B 53/0458
USPC ..... 473/324–350
See application file for complete search history.

(56) References Cited

U.S. PATENT DOCUMENTS 5,288,070 A * 2/1994 Chen ..... A63B 60/00 473/331
5,299,807 A * 4/1994 Hutin ..... A63B 60/54 473/329
5,405,136 A * 4/1995 Hardman ..... A63B 53/04 473/342
5,472,201 A * 12/1995 Aizawa ..... A63B 53/047 473/329
5,669,827 A * 9/1997 Nagamoto ..... A63B 60/00 473/345
5,766,094 A * 6/1998 Mahaffey ..... A63B 53/04 473/342
5,967,903 A * 10/1999 Cheng ..... A63B 60/00 473/342
6,471,604 B2 * 10/2002 Hocknell ..... A63B 53/0466 473/334
6,605,007 B1 * 8/2003 Bissonnette ..... A63B 60/00 473/329
7,070,513 B2 * 7/2006 Takeda ..... A63B 53/047 473/329
7,207,898 B2 * 4/2007 Rice ..... G01N 29/045 473/329

(Continued)

FOREIGN PATENT DOCUMENTS

JP 2003-190336 A 7/2003

*Primary Examiner* — Alvin A Hunter
(74) *Attorney, Agent, or Firm* — Studebaker & Brackett PC

(57) ABSTRACT

A golf club head has a hollow therein and comprises a face portion, a crown portion and a sole portion. The face portion comprises a central zone including a face center, and a peripheral zone surrounding the central zone. Each of the central zone and the peripheral zone has a flexural stiffness defined by $E \times t^3/12$, wherein E is the Young's modulus (GPa) and t is the thickness (mm) of the zone concerned. The ratio sc/sp of the flexural stiffness Sc of the central zone to the flexural stiffness sp of the peripheral zone is 5.0 to 55.0.

18 Claims, 6 Drawing Sheets

(56) References Cited

U.S. PATENT DOCUMENTS 7,361,099 B2 * 4/2008 Rice ..... A63B 53/0466 473/329
7,380,325 B2 * 6/2008 Takeda ..... A63B 53/04 29/505
7,384,348 B2 * 6/2008 Lin ..... A63B 53/04 473/332
7,448,961 B2 * 11/2008 Lin ..... A63B 53/047 473/332
7,682,262 B2 * 3/2010 Soracco ..... A63B 53/0466 473/329
7,931,545 B2 * 4/2011 Soracco ..... A63B 60/42 473/329
8,007,369 B2 * 8/2011 Soracco ..... A63B 60/00 473/332
8,096,897 B2 * 1/2012 Beach ..... A63B 60/00 473/345
8,409,032 B2 * 4/2013 Myrhum ..... A63B 53/04 473/342
8,496,544 B2 * 7/2013 Curtis ..... A63B 60/00 473/345
8,882,609 B2 * 11/2014 Boyd ..... A63B 60/00 473/342
8,894,508 B2 * 11/2014 Myrhum ..... A63B 60/00 473/342
8,926,451 B2 * 1/2015 Deshmukh ..... A63B 53/047 473/349
8,956,247 B2 * 2/2015 Morin ..... A63B 53/0466 473/342
9,283,448 B2 * 3/2016 Sander ..... A63B 53/0466
9,616,304 B2 * 4/2017 Deshmukh ..... B21K 17/00
10,207,162 B2 * 2/2019 Deshmukh ..... A63B 53/0466
10,722,767 B2 * 7/2020 Deshmukh ..... A63B 53/047
11,065,513 B2 * 7/2021 Tassistro ..... A63B 53/08
2003/0162607 A1 8/2003 Tsunoda et al.
2014/0073450 A1 * 3/2014 Hebreo ..... A63B 53/047 473/342
2014/0148271 A1 * 5/2014 Myrhum ..... A63B 60/00 473/342

* cited by examiner

GOLF CLUB HEAD

TECHNICAL FIELD

The present invention relates to a golf club head having a hollow therein.

BACKGROUND ART

For professionals and advanced golfers, a ball hitting sound of a golf club head generated when hitting a ball is one of the important performance aspects of the golf club head.

Japanese Patent Application Publication No. 2003-190336 (Patent Document 1) discloses a golf club head in which, in order to maximize repulsion force of a golf club head against a ball, a frequency transfer function of the head is set within a specific frequency range.

SUMMARY OF THE INVENTION

Problems to be Solved by the Invention

In recent years, high-pitched hitting sounds tend to be shunned by professionals and advanced golfers, and it was revealed that many golfers generally prefer ball hitting sounds whose peak frequencies are lower than 5000 Hz, especially around 4000 Hz. In addition to such frequencies, sufficient reverberation of the ball hitting sound with respect to the duration time, sound pressure and the like is also desired. The golf club head disclosed in the Patent Document 1 did not consider these aspects.

In view of the above problems, the present invention was made, and a primary objective of the present invention is to provide a golf club head capable of improving ball hitting sounds.

According to the present invention, a golf club head has a hollow therein and comprises a face portion, a crown portion and a sole portion, wherein the face portion comprises a central zone including a face center and a peripheral zone surrounding the central zone, the central zone and the peripheral zone each have a flexural stiffness defined by $E \times t^3/12$, wherein "E" is the Young's modulus (GPa) and "t" is the thickness (mm) of the zone concerned, and the ratio sc/sp of a flexural stiffness Sc of the central zone to a flexural stiffness sp of the peripheral zone is in a range from 5.0 to 55.0.

The central zone may be made of the same material as the peripheral zone.

The central zone may comprise a different material than the material of the peripheral zone.

The peripheral zone may comprise a first material, and the central zone may comprise the first material and a second material having a higher Young's modulus than that of the first material.

The second material may be disposed inside the face portion without being exposed from the face portion to the outside thereof.

The ratio sc/sp of the flexural stiffness Sc to the flexural stiffness sp may be in a range from 5.5 to 49.3.

The ratio sc/sp may be in a range from 5.9 to 49.3.

The area of the central zone may be in a range from 2% to 60% of the overall area of the face portion.

The volume of the head may be in a range from 100 to 460 cc, the weight of the head may be in a range from 170 to 280 grams, and the weight of the face portion may be in a range from 35 to 70 grams.

By adopting the above configurations, the golf club head according to the present invention can generate ball hitting sounds having peak frequencies around 4000 Hz and reverberating for a relatively long time.

DESCRIPTION OF THE PREFERRED EMBODIMENTS

Figure 1:
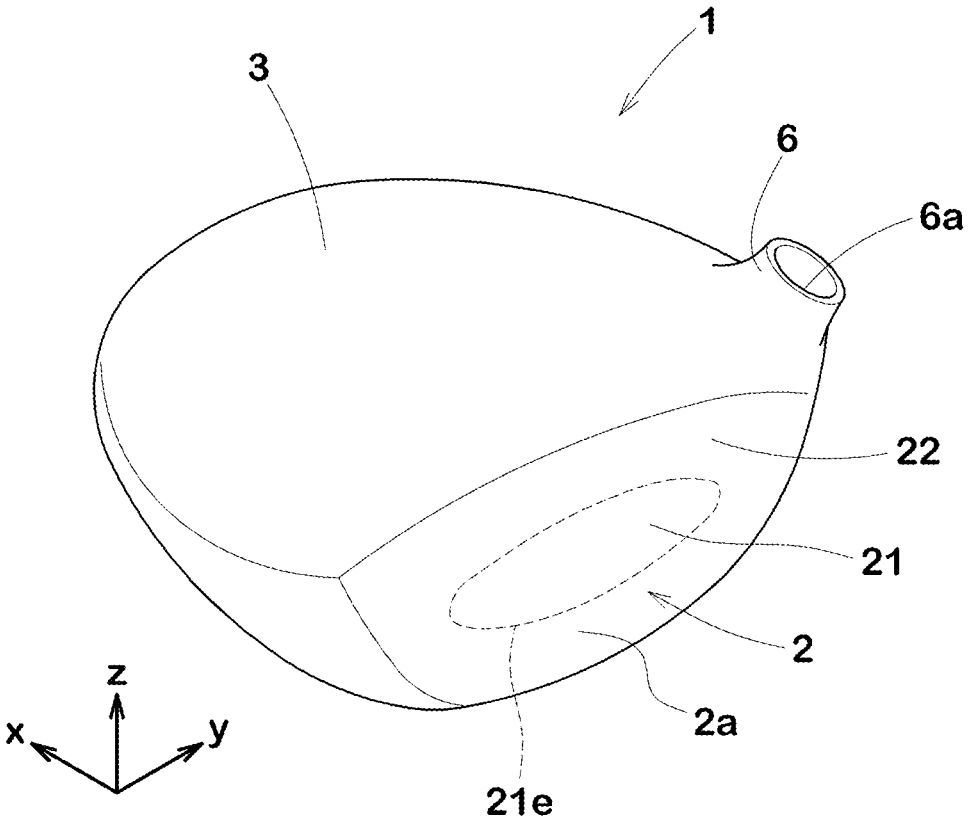
FIG. 1 is a perspective view of a golf club head as an embodiment of the present invention.

Embodiments of the present invention will now be described in detail in conjunction with accompanying drawings. Throughout all embodiments, common elements are assigned with the same reference sign and redundant explanations are omitted.

FIGS. 1-4 show a golf club head 1 as an embodiment of the present invention under the reference state of the golf club head.

Here, the reference state of a club head is such that the club head is set on a horizontal plane HP so that the axis CL of the club shaft (not shown) is inclined at the specified lie angle alpha while keeping the axis on a vertical plane, and the club face forms the specified loft angle beta with respect to the horizontal plane HP. Incidentally, in the case of the club head alone, the center line of the shaft inserting hole **6*a*** can be used instead of the axis of the club shaft.

In this application including the description and claims, dimensions, positions, directions and the like relating to the club head refer to those under a reference state of the club head unless otherwise noted.

Based on the reference state, a front-back direction x, a toe-heel direction y and an up-down direction z of the head are defined as follows.

The front-back direction x is a direction parallel to the horizontal plane HP and orthogonal to the vertical plane VP.

The toe-heel direction y is a direction parallel to both the horizontal plane HP and the vertical plane VP.

The up-down direction z is a direction orthogonal to both the front-back direction x and the toe-heel direction y.

The head 1 has a hollow (i) therein, namely, a substantially closed cavity.

In this embodiment, the head 1 is a so-called wood-type golf club head suitably used for a wood-type golf club. Here, the wood-type golf club includes a driver and a fairway wood. The head 1 in this embodiment is designed for a driver. The present invention is however, not limited to such wood-type golf club heads.

The present invention can be applied to a variety of golf club heads, such as hybrid, iron, putter, etc., as long as the hollow (i) is formed therein.

The volume of the head is not particularly limited. The volume of the head 1 in this embodiment is about 100 to 460 cc, for example. In the case of a driver head, the volume is preferably set in a range from 380 to 460 cc, more preferably 420 to 460 cc.

The weight of the head is not particularly limited. The weight of the head 1 in this embodiment is about 170 to 280 g, for example. In the case of a driver head, the weight is preferably set in a range from 170 to 240 grams, more preferably 170 to 220 grams.

The head 1 comprises a face portion 2, a crown portion 3, and a sole portion 4, which are arranged so as to surround the hollow (i).

In this embodiment, the hollow (i)s void. But, the hollow (i) may be filled with, for example, a foamed material, a gel or the like as needed.

In this embodiment, each of the crown portion 3 and the sole portion 4 is made of a metal material.

As the metal materials, for example, stainless steel, maraging steel, titanium alloy, magnesium alloy, aluminum alloy, etc. can be suitably used. However, it is also possible that a part of the head 1 (e.g., the crown portion 3, etc.) is made of a non-metal material such as a fiber-reinforced plastic.

The face portion 2 is a plate-like part for hitting a ball and disposed in the front of the head 1.

The outer or front surface of the face portion 2 forms the striking surface 2*a* or club face coming into contact with the ball.

The striking surface 2*a* is provided with so called face lines (not shown), namely, parallel grooves extending parallel with the toe-heel direction.

Figure 4:
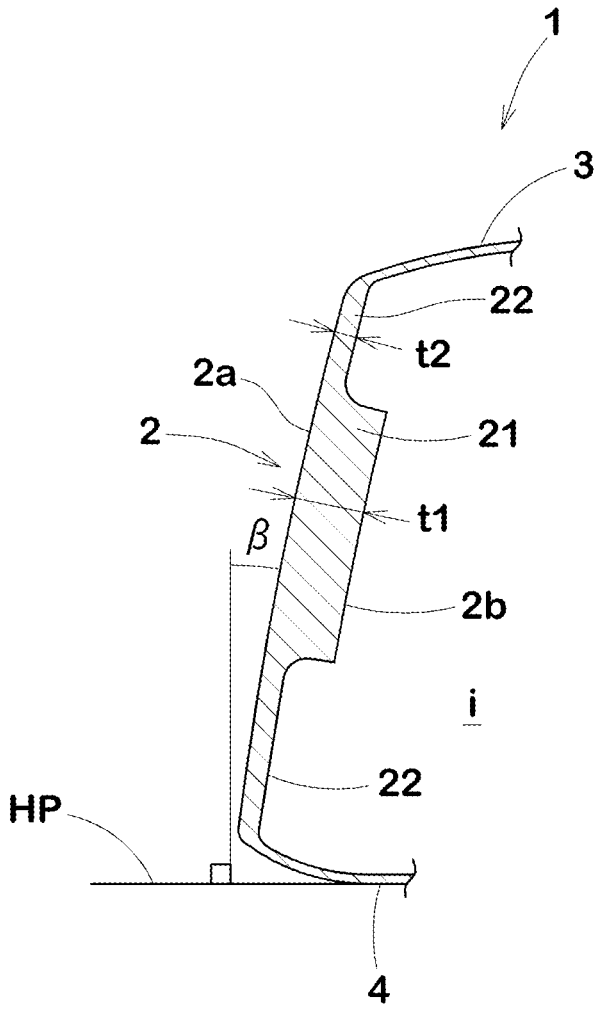
FIG. 4 is a cross-sectional view of the face portion of the golf club head taken along line Iv-iv of FIG. 3.

As shown in FIG. 4, the inner surface 2*b* of the face portion 2 faces the internal hollow (i) without contacting with any other member, and sufficient space is secured behind the face portion 2 so as not to hinder free deflection (elastic deformation) of the face portion 2 when striking a ball and subsequent vibration of the face portion 2.

The crown portion 3 extends from the top edge of the face portion 2 to the rear of the head, and the outer (top) surface of the crown portion 3 forms the top surface of the head. The inner surface of the crown portion 3 faces the hollow (i).

Figure 2:
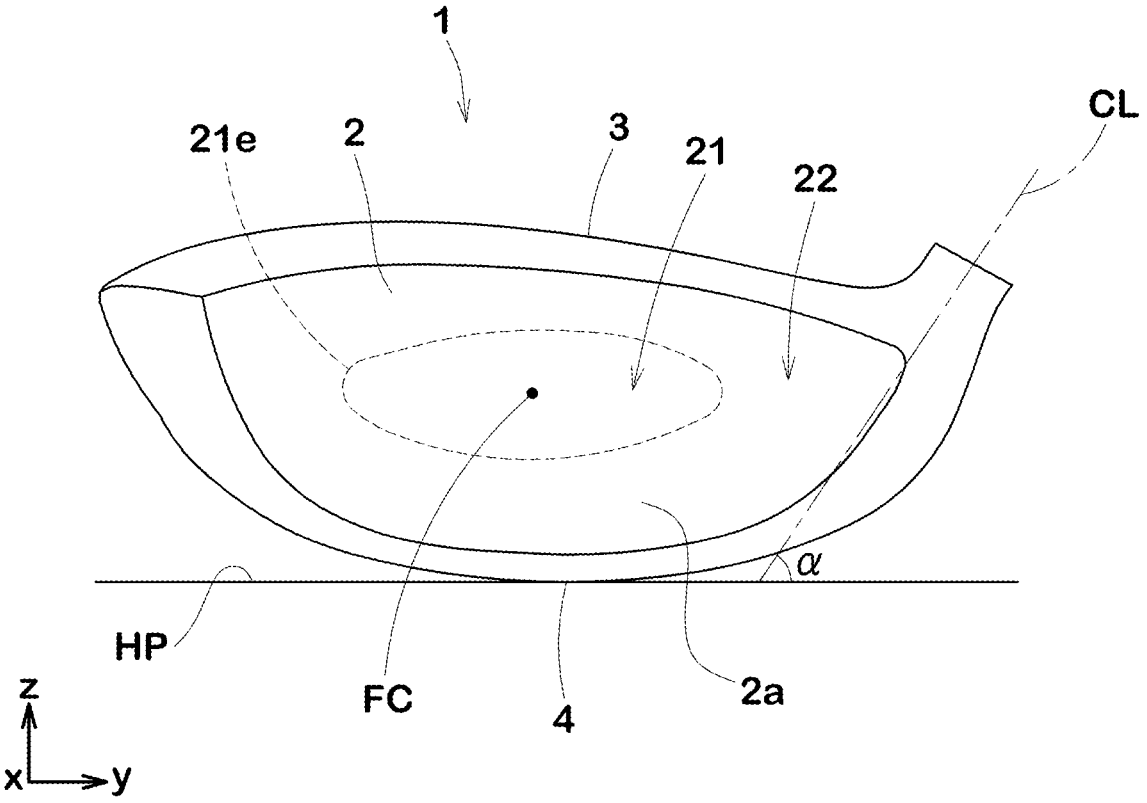
FIG. 2 is a front view of the golf club head.
Figure 3:
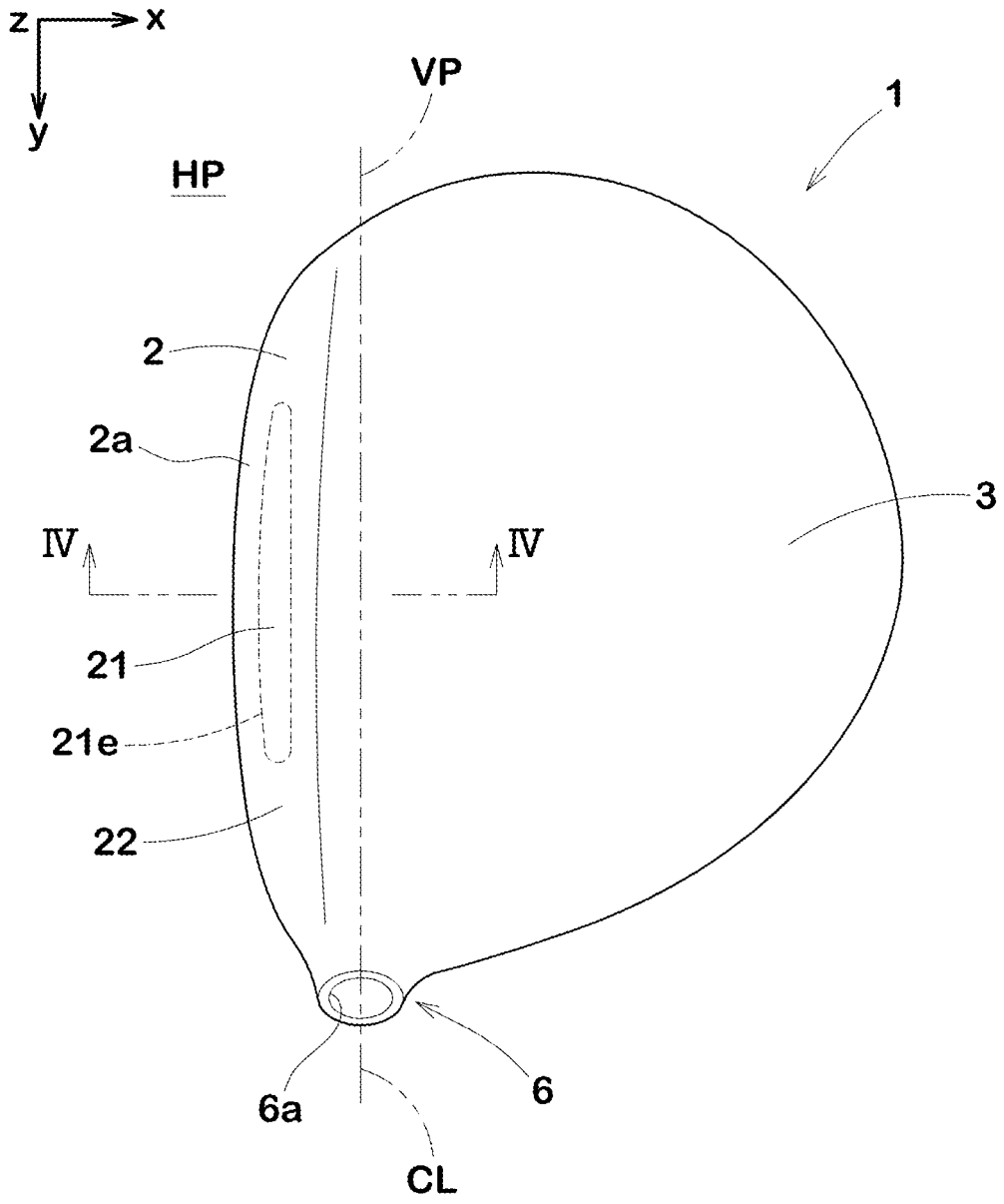
FIG. 3 is a top view of the golf club head.

As shown in FIGS. 1-3, a hosel 6 is provided in a heel side of the crown portion 3. The hosel 6 has a shaft insertion hole 6*a* into which a tip end of a club shaft (not shown) is inserted and fixed.

The sole portion 4 extends from the lower edge of the face portion 2 to the rear of the head, and its outer surface forms the bottom surface of the head. The inner surface of the sole portion 4 faces the hollow (i) as shown in FIG. 4.

As shown in FIG. 2, the face portion 2 comprises a central zone 21 including the face center FC, and a peripheral zone 22 extending around the central zone 21 to surround the central zone 21.

In this embodiment, the peripheral zone 22 is formed as an annular portion which forms the entire area of the face portion 2 except for the central zone 21.

The boundary line 21*e* between the central zone 21 and the peripheral zone 22 is indicated by a dashed line in FIGS. 1 to 3.

The face center FC means the so called sweet spot. The sweet spot is the intersection of the striking surface 2*a* and a straight line drawn from the center of gravity of the head perpendicularly to the striking surface 2*a*.

The central zone 21 and the peripheral zone 22 each have a flexural stiffness defined by an equation: $E \times t^3/12$.

This equation is a general equation expressing the flexural stiffness of a flat plate, wherein E and t are the Young's modulus (GPa) and the thickness (mm) of the flat plate, respectively.

The central zone 21 has a Young's modulus E1 (GPa) and a thickness t1 (mm), and the peripheral zone 22 has a Young's modulus E2 (GPa) and a thickness t2 (mm), therefore, the flexural stiffness Sc of the central zone 21 is given by $E1 \times t1^3/12$, and the flexural stiffness sp of the peripheral zone 22 is given by $E2 \times t2^3/12$.

If the above-mentioned face lines are formed in the face portion 2, the thickness shall be determined, supposing that the face lines are not formed. This is because the depth of the face lines is so small that the face lines have no real effect on the flexural stiffness.

According to the present invention, the ratio sc/sp of the flexural stiffness Sc to the flexural stiffness sp is set in a range from 5.0 to 55.0.

As a result of various experiments conducted by the inventors, it was found that there is a certain relationship between the ball hitting sound and the flexural stiffness of the face portion 2.

Specifically, it was found that, by increasing the flexural stiffness Sc of the central zone 21 of the face portion 2, and decreasing the flexural stiffness sp of the peripheral zone 22 of the face portion 2, while limiting the ratio sc/sp to a certain range, it is possible to obtain good ball hitting sound having frequency of around 4000 Hz and sufficient reverberation.

As described above, the head 1 according to the present invention is based on the novel idea of improving the ball hitting sound by improving the distribution of the flexural stiffness of the face portion 2.

Therefore, the head 1 can provide an advantage of increased design freedom (especially for components other than the face portion 2).

In this embodiment, as shown in FIG. 4, the thickness t1 of the central zone 21 is greater than the thickness t2 of the peripheral zone 22.

In this embodiment, the thickness t1 of the central zone 21 is a substantially constant, and the thickness t2 of the peripheral zone 22 is a substantially constant.

Here, the expression "substantially constant" means that variations of from +0.20 mm to −0.20 mm may be included.

Further, the face portion 2 may be provided, between the central zone 21 and the peripheral zone 2, with a transitional zone whose thickness is gradually varied from the thickness t1 to the thickness t2. Even in such case, a good ball hitting sound can be obtained by controlling the flexural stiffness of the central zone 21 and the peripheral zone 22 within the above-mentioned range.

In the face portion 2 in this embodiment, the central zone 21 and the peripheral zone 22 are made of the same metal material (for example, a titanium alloy), therefore, with respect to Young's modulus, the central zone 21 is the same as the peripheral zone 22.

on the other hand, with respect to the thickness, the central zone 21 is larger than the peripheral zone 22.

In this embodiment, therefore, by adjusting the thicknesses of the central zone 21 and the peripheral zone 22, the flexural stiffness ratio sc/sp is set in the above range.

If the flexural stiffness ratio sc/sp is less than 5.0, the ball hitting sound tends to become high-frequency sound, which is undesirable.

If the flexural stiffness ratio sc/sp exceeds 55.0, the difference in stiffness between the central zone 21 and the peripheral zone 22 becomes large, and the durability of the face portion 2 may be reduced.

Therefore, in order to further improve the ball hitting sound without compromising the durability of the face portion 2, the flexural stiffness ratio sc/sp is preferably set in a range from 5.5 to 49.3, more preferably in a range from 5.9 to 49.3.

Similarly, if the thickness t2 of the peripheral zone 22 is excessively small, it may reduce the durability of the face portion 2.

Therefore, although not particularly limited, the thickness t2 of the peripheral zone 22 is, for example, set to be not less than 1.00 mm, preferably not less than 1.30 mm, more preferably not less than 1.40 mm in order to further improve the ball hitting sound while maintaining the durability of the face portion 2.

In this embodiment, in order to further improve the ball hitting sound, the area of the central zone 21 having a relatively high flexural stiffness Sc is, for example, set in a range from 2% to 60%, preferably 2% to 50%, more preferably 2% to 40% of the overall area of the face portion 2.

For the sake of convenience, the overall area of the face portion 2 is defined by the area enclosed by the contour line of the head determined in the front view of the head under the reference state.

Thus, the overall area may include the area of a part of the crown portion 3 and/or sole portion 4 viewable in the front view. On the other hand, the area of the central zone 21 is defined by the area enclosed by the boundary line 21*e* (shown in FIGS. 1-3) of the central zone 21 which is projected onto the striking surface 2*a* of the face portion 2 in the front view of the head under the reference state.

It is preferable that the central zone 21 has a horizontally long shape in which the length in the head toe-heel direction y is greater than the height in the up-down direction z, so as to correspond to the contour shape of the face portion 2. This helps to make the duration time of the reverberation of the ball hitting sound longer.

It is also preferable that the shape of the central zone 21 is oval or ellipsoidal so as to cover an area where golfers' ball hitting positions concentrate.

It is especially preferable that the shape of the central zone 21 is such that the centroid thereof is located at a distance of from 0 to 5 mm from the above-mentioned face center FC. By adopting such arrangements, a good ball hitting sound can be obtained over a wide range of hitting positions on the face portion 2 while improving the rebound performance of the head 1.

The weight of the face portion 2 affects the vibration of the face portion 2.

In this embodiment, therefore, in order to further improve the ball hitting sound of the head 1, the weight of the face portion 2 is limited to a certain range. Preferably, the weight of the face portion 2 is, for example, set in a range from 35 to 70 g, preferably 45 to 70 g, more preferably 50 to 70 g.

Figure 5:
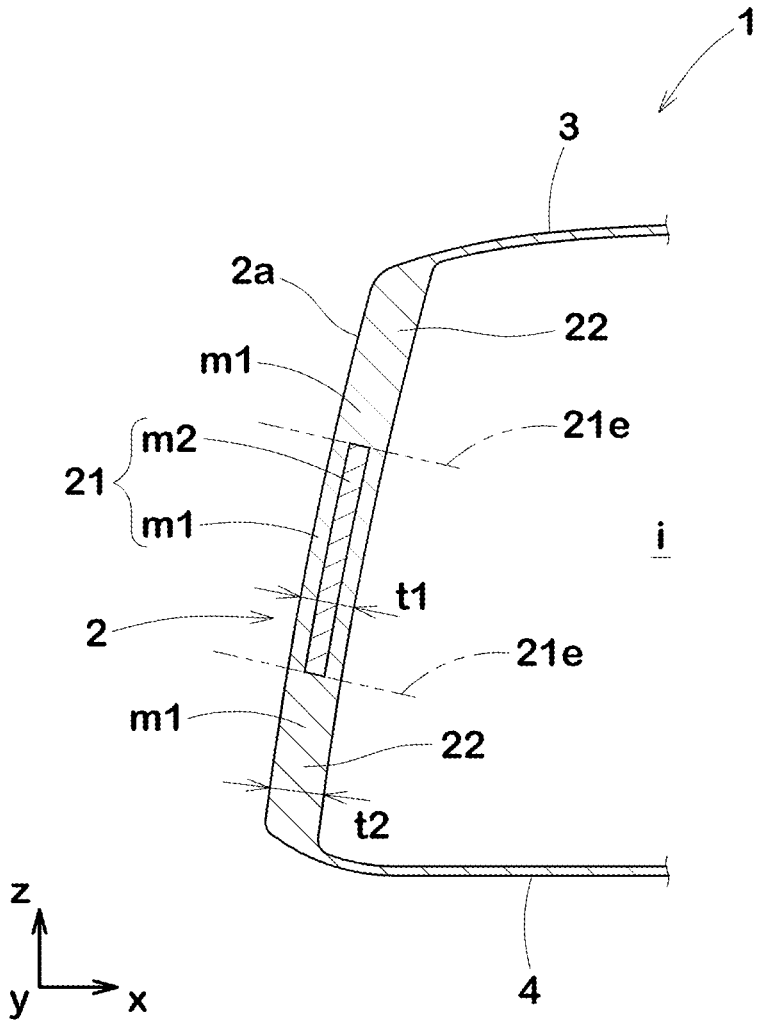
FIG. 5 is a cross-sectional view of the face portion of a golf club head as another embodiment of the present invention taken along a line corresponding to the line Iv-iv of FIG. 3.

Another embodiment of the present invention is shown in FIG. 5. FIG. 5 is a cross section taken along a line corresponding to the line IV-IV in FIG. 3.

As shown, the central zone 21 of the face portion 2 in this embodiment comprises a different material than the material of the peripheral zone 22.

Thus, the face portion 2 can be formed of two or more different materials. As a result, it becomes possible to adjust the flexural stiffness ratio sc/sp a desired range while reducing the change in the thickness of the face portion 2.

In this embodiment, the peripheral zone 22 is formed of only a first material m1 having a Young's modulus Ef.

The first material m1 is a titanium alloy (Young's modulus: about 120 GPa) as in the previous embodiment.

The central zone 21 is formed of two materials: one is the first material m1, and the other is a second material m2 having a Young's modulus Ec, wherein the Young's modulus Ec is greater than the Young's modulus Ef.

In the face portion 2 in this example, the first material m1 forms an outer surface layer having a thickness tf and an inner surface layer having a thickness tf. And, the second material M2 is sandwiched therebetween to form an interlayer having a thickness tc.

When the face portion 2 is formed from the combined materials shown in FIG. 5, the flexural stiffness of the part formed from the combined materials, namely, the flexural stiffness Sc of the central zone 21, can be obtained by the following equation (2):

the flexural stiffness *Sc* of the central zone=the flexural stiffness *Scf* of the outer/inner surface layer×2+the flexural stiffness *S*0 due to axial force generated in the surface layers+the flexural stiffness *Scc* of the interlayer, (2)

wherein each flexural stiffness Scf, Scc and S0 is as follows:

$$Scf=Ef\times tf^3/12$$

$$Scc=Ec\times tc^3/12$$

$$S0=Ef\{tf(tf+tc)^2/2\}$$

In this case, the flexural stiffness ratio sc/sp can be adjusted to a desired range while making the difference t1−t2 in thickness between the central zone 21 and the peripheral zone 22 smaller as compared to the previous embodiment (in this example, the difference t1−t2 is zero). Thus, in this embodiment, it is possible to adjust the flexural stiffness without significant difference in the thickness of the face portion 2.

Therefore, the damage caused by cutting effect and the like can be effectively suppressed.

As to the second material M2, a variety of materials can be employed. But, it is preferable to use a material having a Young's modulus greater than that of the first material m1. For example, if the first material m1 is a titanium alloy having a Young's modulus of 120 GPa, any material having a Young's modulus greater than 120 GPa may be employed for the second material m2.

Such second material m2 includes various high rigidity materials, e.g. copper alloys (129 GPa and up), steel (201 GPa and up), zirconia (Young's modulus: about 210 GPa), molybdenum (324 GPa), alumina (Young's modulus: about 360 GPa), and the like.

Furthermore, in this embodiment, the second material M2 is disposed inside the face portion 2 without being exposed from the face portion 2 to the outside of the face portion 2. That is, the first material m1 whose Young's modulus is lower than the second material m2, is located on both sides in the front-back direction x, both sides in the toe-heel direction y and both sides in the up-down direction z, of the second material m2 having the higher Young's modulus.

With such arrangement, the first material M1 and the second material M2 are strongly joined together, therefore it is possible to provide the face portion 2 having excellent durability.

Figure 6:
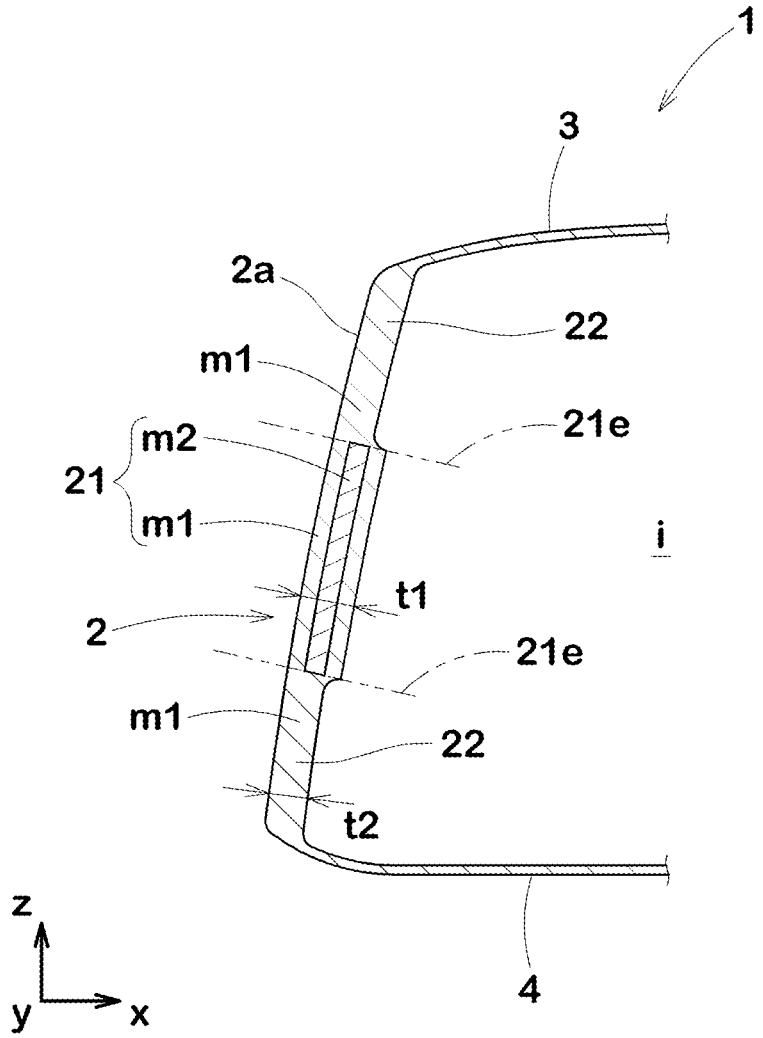
FIG. 6 is a cross-sectional view of the face portion of a golf club head as still another embodiment of the present invention taken along a line corresponding to the line Iv-iv of FIG. 3.

Still another embodiment of the present invention is shown in FIG. 6. FIG. 6 is a cross section taken along a line corresponding to the line Iv-iv in FIG. 3.

This embodiment is a modification of the face portion 2 shown in FIG. 5, wherein the thickness t2 of the peripheral zone 22 is set to be less than the thickness t1 of the central zone 21. In this case, the flexural stiffness ratio sc/sp can be readily adjusted to a larger value.

While detailed description has been made of preferable embodiments of the present invention, the present invention is not limited to the illustrated embodiments, and can be embodied in various forms within the scope of the technical idea described in the claims. Further, the embodiments disclosed in the present specification may be implemented independently, or may be implemented in combination so as to include respective features. Further, it goes without saying that the present invention includes equivalents thereof.

First Working Examples

Based on the overall structure shown in FIGS. 1-3 and the face structure shown in FIG. 4, hollow golf club heads were experimentally manufactured, and their hitting sounds were evaluated in order to verify the effectiveness of the present invention. All of the golf club heads have the same specifications except for those of the face portions.

The specifications are shown in Table 1.

The common specifications are as follows:

the volume of the head: 460 cc the material of the face portion: Titanium alloy

<Test Methods>

Each golf club head was attached to a golf club shaft to make a golf club. Then, using a swing robot, the golf club struck a ball at the face center at a head speed of 35 m/s, and the ball hitting sound was sampled utilizing a noise level meter. The sampled ball hitting sound was analyzed by the use of an FFT analyzer to determine a first-order peak frequency of the ball hitting sound. Further, the duration time of the reverberation was determined utilizing a wavelet analysis method. The results are indicated in Table 1 by an index based on the comparative example 1 being 100, wherein the larger the number, the longer the duration time.

Further, in order to evaluate the durability of the golf club heads, each of the golf clubs repeatedly struck a ball until the head was broken, but up to a predetermined times. If the head was broken, the number of the hits was recorded. The results are indicted in Table 1 by an index based on the comparative example 1 being 100, wherein the larger the number, the better the durability.

TABLE 1

<Single material>

| head | Compar. Ex. 1 | compar. ex. 2 | compar. ex. 3 | Ex. 1 | Ex. 2 | Ex. 3 |
|---|---|---|---|---|---|---|
| face portion | | | | | | |
| structure | FIG. 4 | FIG. 4 | FIG. 4 | FIG. 4 | FIG. 4 | FIG. 4 |
| weight (g) | 65 | 65 | 65 | 65 | 65 | 65 |
| central zone | | | | | | |
| area/overall area (%) | 45 | 45 | 45 | 45 | 45 | 45 |
| flexural stiffness Sc (GPa $mm^3$) | 295.4 | 389.8 | 2142.0 | 544.1 | 1096.7 | 1649.9 |
| Young's modulus (GPa) | 119.0 | 119.0 | 119.0 | 119.0 | 119.0 | 119.0 |
| thickness t1(mm) | 3.1 | 3.4 | 6 | 3.8 | 4.8 | 5.5 |
| peripheral zone | | | | | | |
| flexural stiffness Sp (GPa $mm^3$) | 154.9 | 120.7 | 21.8 | 91.8 | 40.6 | 33.5 |
| Young's modulus (GPa) | 119.0 | 119.0 | 119.0 | 119.0 | 119.0 | 119.0 |
| thickness t2 (mm) | 2.5 | 2.3 | 1.3 | 2.1 | 1.6 | 1.5 |
| Sc/Sp | 1.9 | 3.2 | 98.3 | 5.9 | 27.0 | 49.3 |
| Frequency (Hz) | 5700 | 5100 | 3500 | 4200 | 3800 | 3700 |
| Reverberation | 100 | 100 | 100 | 100 | 100 | 100 |
| Durability | 100 | 100 | 60 | 100 | 95 | 90 |

From the test results, it was confirmed that the golf club heads as working examples generated better ball hitting sounds than the comparison examples.

Second Working Examples

Based on the overall structure shown in FIGS. 1-3 and the face structures shown in FIGS. 5 and 6, hollow golf club heads were experimentally manufactured, and their hitting sounds were evaluated in order to verify the effectiveness of the present invention.

All of the golf club heads have the same specifications except for those of the face portions.

The specifications are shown in Table 2.

The materials used for the face portions are as follows:

Material having Young's modulus 210 GPa: zirconia alloy

Material having Young's modulus 360 GPa: Alumina

Material having Young's modulus 650 GPa: Tungsten carbide alloy

The test methods were the same as described above.

The test results are shown in Table 2 in the same way as described above.

TABLE 2

<combined materials>

| head | Ex. 4 | Ex. 5 | Ex. 6 | Ex. 7 |
|---|---|---|---|---|
| face portion | | | | |
| structure | FIG. 6 | FIG. 6 | FIG. 6 | FIG. 6 |
| weight (g) | 65 | 65 | 65 | 65 |
| Central zone | | | | |
| area/overall area (%) | 45 | 45 | 45 | 45 |
| flexural stiffness Sc (GPa $mm^3$) | 506.9 | 710.6 | 985.0 | 1228.8 |
| thickness t1 (mm) | 3.6 | 3.8 | 3.8 | 4.5 |
| first material | | | | |
| Young's modulus (GPa) | 119.0 | 119.0 | 119.0 | 119.0 |
| thickness (mm) | 0.9 | 0.5 | 0.5 | 0.5 |

TABLE 2-continued

| <combined materials> | | | | |
|---|---|---|---|---|
| head | Ex. 4 | Ex. 5 | Ex. 6 | Ex. 7 |
| second material | | | | |
| Young's modulus (GPa) | 210.0 | 210.0 | 360.0 | 210.0 |
| thickness (mm) | 1.8 | 2.8 | 2.8 | 3.0 |
| Peripheral zone | | | | |
| flexural stiffness Sp (GPa $mm^3$) | 91.8 | 91.8 | 79.3 | 68.0 |
| Young's modulus(GPa) | 119.0 | 119.0 | 119.0 | 119.0 |
| thickness t2 (mm) | 2.1 | 2.1 | 2.0 | 1.9 |
| Sc/Sp | 5.5 | 7.7 | 12.4 | 18.1 |
| Frequency (Hz) | 4400 | 4200 | 4100 | 4000 |
| Reverberation | 100 | 100 | 100 | 100 |
| Durability | 100 | 100 | 99 | 98 |

From the test results, it was confirmed that the golf club heads as working examples generated better ball hitting sounds.

DESCRIPTION OF THE REFERENCE SIGNS

1 golf club head
2 face portion
3 crown portion
4 sole portion
21 central zone
22 peripheral zone
FC face center
i hollow
m1 first material
m2 second material

The invention claimed is:

1. A golf club head having a hollow therein and comprising a face portion, a crown portion and a sole portion,
wherein
the face portion comprises a central zone including a face center and a peripheral zone surrounding the central zone,
wherein
the peripheral zone comprises a first material, and
the central zone comprises the first material and a second material having a Young's modulus higher than that of the first material,
wherein
the central zone and the peripheral zone each have a flexural stiffness defined by $E \times t^3/12$, wherein "E" is the Young's modulus (GPa) and "t" is the thickness (mm) of the zone concerned, and
the ratio Sc/Sp of a flexural stiffness Sc of the central zone to a flexural stiffness Sp of the peripheral zone is in a range from 12.4 to 55.0.

2. The golf club head according to claim 1, wherein
the peripheral zone has a single-layered structure made of the first material, and
the central zone has a three-layered structure made up of an outer surface layer, an inner surface layer and an interlayer therebetween, wherein the outer surface layer and the inner surface layer are made of the first material, and the interlayer is made of the second material.

3. The golf club head according to claim 2, wherein
the second material is disposed inside the face portion without being exposed from the face portion to the outside thereof.

4. The golf club head according to claim 3, wherein
the central zone has a substantially constant thickness, and the peripheral zone has a substantially constant thickness.

5. The golf club head according to claim 4, wherein
the central zone has a substantially constant thickness, the peripheral zone has a substantially constant thickness, the outer surface layer has a substantially constant thickness, and the inner surface layer has a substantially constant thickness.

6. The golf club head according to claim 5, wherein
the area of the central zone is in a range from 2% to 60% of the overall area of the face portion.

7. The golf club head according to claim 6, wherein
the volume of the head is in a range from 100 to 460 cc,
the weight of the head is in a range from 170 to 280 grams, and
the weight of the face portion is in a range from 35 to 70 grams.

8. The golf club head according to claim 7, wherein
the ratio Sc/Sp is in a range from 12.4 to 49.3.

9. The golf club head according to claim 1, wherein
when the club head is attached to a golf club shaft to make a golf club, and the golf club strikes a ball at the face center at a head speed of 35 m/s, the club head generates a ball hitting sound whose first-order peak frequency is 3700 to 4400 Hz.

10. A golf club head having a hollow therein and comprising a face portion, a crown portion and a sole portion,
wherein
the face portion comprises a central zone including a face center and a peripheral zone surrounding the central zone,
the central zone and the peripheral zone each have a flexural stiffness defined by $E \times t^3/12$, wherein "E" is the Young's modulus (GPa) and "t" is the thickness (mm) of the zone concerned, and
the ratio Sc/Sp of a flexural stiffness Sc of the central zone to a flexural stiffness Sp of the peripheral zone is in a range from 12.4 to 55.0, wherein
the central zone comprises a different material than the material of the peripheral zone;
the peripheral zone comprises a first material;
the central zone comprises the first material and a second material having a Young's modulus higher than that of the first material; and
the central zone is thicker than the peripheral zone.

11. The golf club head according to claim 10, wherein
the peripheral zone has a single-layered structure made of the first material, and
the central zone has a three-layered structure made up of an outer surface layer, an inner surface layer and an interlayer therebetween, wherein the outer surface layer and the inner surface layer are made of the first material, and the interlayer is made of the second material.

12. The golf club head according to claim 11, wherein
the second material is disposed inside the face portion without being exposed from the face portion to the outside thereof.

13. The golf club head according to claim 12, wherein
the central zone has a substantially constant thickness, and the peripheral zone has a substantially constant thickness.

14. The golf club head according to claim 13, wherein
the central zone has a substantially constant thickness, the peripheral zone has a substantially constant thickness, the outer surface layer has a substantially constant thickness, and the inner surface layer has a substantially constant thickness.

15. The golf club head according to claim 14, wherein the area of the central zone is in a range from 2% to 60% of the overall area of the face portion.

16. The golf club head according to claim 15, wherein the volume of the head is in a range from 100 to 460 cc, the weight of the head is in a range from 170 to 280 grams, and the weight of the face portion is in a range from 35 to 70 grams.

17. The golf club head according to claim 16, wherein the ratio Sc/Sp is in a range from 12.4 to 49.3.

18. The golf club head according to claim 10, wherein when the club head is attached to a golf club shaft to make a golf club, and the golf club strikes a ball at the face center at a head speed of 35 m/s, the club head generates a ball hitting sound whose first-order peak frequency is 3700 to 4400 Hz.

* * * * *